US005890302A

United States Patent [19]

Kirkis

[11] Patent Number: 5,890,302

[45] Date of Patent: Apr. 6, 1999

[54] DISPOSABLE PROTECTIVE COVER

[75] Inventor: E. Jacquelyn Kirkis, Tucson, Ariz.

[73] Assignee: E Jacquelyn Kirkis, Tucson, Ariz.

[21] Appl. No.: 16,953

[22] Filed: Feb. 2, 1998

Related U.S. Application Data

[63] Continuation-in-part of Ser. No. 675,251, Jul. 1, 1996, abandoned.

[51] Int. Cl.[6] ..... A43B 11/00; A43B 3/16

[52] U.S. Cl. ..... 36/138; 36/7.1 R; 36/72 R

[58] Field of Search ..... 36/138, 7.1 R, 36/7.3, 8.1, 72 R, 9 R, 9 A

[56] References Cited

U.S. PATENT DOCUMENTS

| | | | |
|---|---|---|---|
| D. 337,420 | 7/1993 | Bayer . | |
| 2,171,654 | 9/1939 | Hinchliff et al. | 36/72 R |
| 3,335,506 | 8/1967 | Pence | 36/7.1 R |
| 3,442,034 | 5/1969 | Moore et al. | 36/7.1 R |
| 4,713,895 | 12/1987 | Vallieres | 36/7.1 AR |
| 4,722,143 | 2/1988 | Everett . | |
| 4,825,564 | 5/1989 | Sorce | 36/7.1 R |
| 5,144,759 | 9/1992 | Mascotte | 36/7.1 R |
| 5,228,215 | 7/1993 | Bayer | 36/9 R |
| 5,394,624 | 3/1995 | Siepser | 36/9 R |

*Primary Examiner*—Ted Kavanaugh

[57] ABSTRACT

A disposable protective shoecover for use by health care workers is formed by two pieces of fluid resistant, fluid proof, impermeable material sealed along the outer edges except at the back. The back of the shoecover is closed by two double coated adhesive closures spaced at two intervals along the back. The upper most closure is spaced two inches from the top of the shoecover. The closures can be easily released by inserting a finger in a top of the back of the shoecover and then removing the shoecover, whereby the finger only touches an interior of the shoe cover upon removal. This protects the wearer from touching any exterior portion of the shoecover which may be contaminated.

1 Claim, 1 Drawing Sheet

DISPOSABLE PROTECTIVE COVER

REFERENCE TO RELATED APPLICATION

This is a continuation in part of application Ser. No. 08/675,251, filed Jul. 1, 1996 now abandoned.

FIELD OF THE INVENTION

The invention is in the field of healthcare worker protection, more particularly the invention is used to prevent contact of the skin of foot, ankle and lower leg, from knee to foot, with blood or body fluids considered infectious and may be splashed or spattered in the area of trauma, surgery, infant delivery, and invasive procedures.

BACKGROUND OF THE INVENTION

Disposable foot coverings have been in use in healthcare settings since 1950. The intent of such coverings was to provide a means of holding a non conductive strip to the shoe of healthcare workers to protect the worker from electric sparks produced by friction on the asphalt flooring in surgeries. These sparks caused high risk of fire and explosions of gases used in surgery. Non woven fiberous paper type material in the shape of a shoe cover, provided the way for the non conductive strip to hold to the shoe. These covers as cheap, one time use, protection were very porous to liquids and the fluids splashed or spattered about in healthcare procedures. These covers gave the impression of keeping the shoes clean, a secondary benefit of the cover. These covers did not protect the skin of the foot, ankle or leg from contact with potentially infectious fluids. In 1950, the asphalt flooring in surgeries was discontinued. Disposable shoe covers of the non woven paper construction, continued to be used by healthcare workers and technicians until the FINAL RULE: Blood Borne Pathogen regulation by the federal government came into effect on Dec. 6, 1991. At that time, the reason for the shoe cover changed from the protection of the shoe, to the protection of the skin of the health care worker. The nonwoven paper type cover did not prevent the soak through of splashed blood or body fluids on to the shoe. There was no protection for the skin of the foot, ankle, or leg as the paper covered only the shoe. Access to covers which did protect the skin have became an imperative.

U.S. Pat. No. 4,825,564, Joan P. Sorce, teaches of outdoor, cold weather protective cover for the foot, which does extend over the ankle and the lower leg. Disadvantages here is that it is for outdoor use, soley and is not disposable for one time use; it does not offer any means of removal which keeps the hands from contamination with the soiling on the outside of the cover.

U.S. Design Pat. No. 337,420; and U.S. Pat. No. 5,228,215, Robert T. Bayer, both teach of a disposable shoe cover for use in healthcare. Disadvantages here is that the skin is not protected with either of these covers. Neither model can be removed without soiling the hands by the touching contamination on the outside of the cover.

U.S. Pat. No. 4,713,895, Francois Filliers, of Quebec Canada, teaches of a spat type cover for the upper part of the shoe only, leaving the sole of the shoe vulnerable to contamination and soiling. This model does open at the back however extends the opening through to the sole of the shoe at the heel making seepage possible onto the shoe and thus to the skin of the user. Although there is a similar method of removal by opening the unsealed back seam of Villier's gaiter, there is the risk of contamination to the inside of the cover from the unsecured portions of the cover around the edge of the sole of the shoe of the wearer. This risk extends to the risk of skin contamination of the ankle, and lower leg as well as the foot. This model also precludes the necessity of having a special shoe with the attachments for the upper portion suggested by the inventor. This is a needless cost in healthcare. The release of the cover by Villier is similar to the invention of this application, however, the release poses risk of hand contamination.

It is the principle object of the present invention to provide a disposable, one time use, protective cover for the skin of the foot, ankle, and lower leg, from knee to foot, shaped as a boot, which goes easily over the entire shoe of healthcare workers.

It is a further object of this present invention to provide a disposable, one time use, protective cover for the skin of the foot, ankle and lower leg from knee to foot, shaped as a boot, going over the entire shoe constructed of a material which is fluid resistant, fluid proof, and impermeable to liquid soak through.

It is another object of this invention to provide a disposable, one time use, protective cover for the skin of the foot, ankle, and lower leg from knee to foot, shaped as a boot, going over the entire shoe which can be removed without soiling the hands of the wearer.

It is a further object of this invention to provide a disposable, one time use, protective cover for the skin of the foot, ankle and lower leg from the knee to the foot, shaped as a boot, going over the entire shoe, which has the feature of adjustability for comfort for the user.

Another object of this invention is to provide ventilation for relief of heat generating material which is fluid resistant, fluid proof, and impermeable to fluid soak through.

Another object of this invention is to provide a disposable, one time use, protective cover for the skin of the foot, ankle, and lower leg, from knee to foot, shaped as a boot, going over the shoe which is of a simple design to make and manufacture of the least cost possible.

The present invention, called THE HASTY BOOT is recognized to be subject to many changes and modifications, without departing from the spirit or essential characteristics of the present invention, as set forth in the appended claim.

SUMMARY OF THE INVENTION

In accordance with the foregoing background description, the invention provides a unique protective construction, for the disposable one time use cover. The cover is fashioned in the shape of a boot, cut as two mirror pieces. The two pieces are bonded together by heat sealing, or seal stitching, depending on the type of material used for construction. Two types of material have been used for the construction: PVC flexible vinyl, and Tyvek FC, an olefin spinbonded material patented by Dupont Corporation. Both of these materials are fluid resistant, fluid proof, and impermeable thus preventing strike through or soak through of blood or fluids to the skin. The invention is further unique in that a portion of the back seam is open, entending from the top of the back of the heel to the top of the boot shaped cover. The foot in the shoe is inserted into the opening of this back seam, and into the boot shaped cover. Closure is accomplished by adjusting the sides of the open seam around the calf of the leg to the comfort of the wearer. The seam opening is closed around the calf of the leg using release coated tapes at two measured points along the seam. Ventilation for the boot shaped cover is achieved through the unsealed portion of the back seam between the closures.

The cover is removed by opening the back seam closures by tearing the closures open and folding the cover down over the foot, thus touching the clean inside only. The hands do not come in contact with the soiled outside of the cover.

The seal bonded or seal stitched seam, is continuous from the top of the front of the boot shaped cover, under the sole, to the top of the heel at the back. At the top of the back of the heel, the seam is double sealed to reduce risk of ripping or tearing. The release coated tapes, manufactured by 3-M for this invention, are placed at two points along the open portion of the back seam. The top closure is placed 2" from the top of the open back seam, and the bottom closure is placed 2" from the double sealed point at the top of the back of the heel. These tapes are easily released to adjust the fit of the cover. These tapes are easily torn apart by inserting a finger at the top of the open back seam and popping the tapes apart. The clean inside is then available for the hand to push the cover down over the foot and off. The soiled outside thus is wrapped on the inside. The cover is literally turned wrong side out when removed. Disposal is done in the regular trash as the material used is environmentally non-hazardous.

The materials used for the construction of the disposable cover are inexpensive, the pattern is simple, the manufacture with bonding or seal stitching of the two shapes together is easy to do making the disposable, one time use protective cover economically attractive.

DETAILED DESCRIPTION OF THE INVENTION

Figure 1:
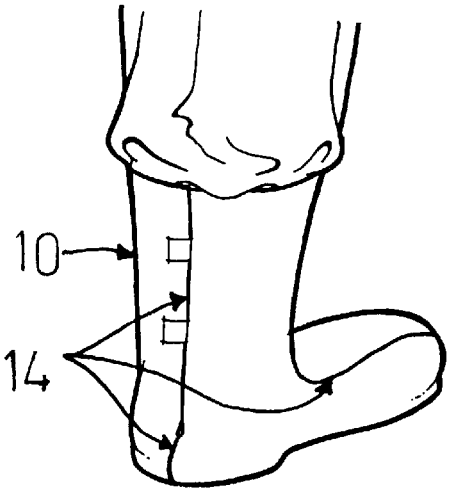
FIG. 1. The perspective of a disposable one time use protective cover fashioned as a boot with a continuous seam joining two mirror pieces of material, according to the subject invention; extending from top of cover at front, over top of toe, under sole of boot to top of back of heel, stopping with a double seal at the top of the heel, with seam open from top of heel to top of boot shaped cover; in closed position of wearing, showing two tape closures in position to close open portion of seal around lower leg FIG. 2. The disposable, one time use protective boot shaped cover showing open back seam from top of heel to top of cover. Inner portion of seam indicating seal stitching with seal in place shown on inside of boot shaped cover as back seam is shown in open position. Dotted lines on top of toe indicate the outside view of stitching used for Tyvek FC material. Seal bonding is used on the PVC flexible vinyl material, and is indicated as the solid line. Tape closures are shown along the side of the open portion of the back seam, at the measured intervals.

Referring to the specific Figures of 1–4 the embodiment of the invention called HASTY BOOT a disposable one time use, protective cover for the skin of the foot, ankle, and lower leg knee to foot, fashioned as a boot shape covering entire shoe and sole, to be used by healthcare workers and in industry clean room environments. FIG. 1 denotes the boot shaped disposable one time use, protective cover as general reference 10. Shown is the protective cover as worn over the shoe and covering the leg, ankle and foot. The number 14 denotes the seam joining the mirror pieces of boot shaped cover, which runs from the top of the front over the toe, under the sole, up the heel to the top of the back of the cover. This seam is seal bonded, or seal stitched to the point 18 at the top of the heel at the back. At the point 18 the seam is double sealed to stop ripping. The seam at the back of the cover is open from the double sealed point, 18, to the top of the boot shaped cover. The stitched seam is covered with a strip of sealing tape to close the needle holes, 16. Two types of material which are fluid resistant, fluid proof, and impereable are used to construct the boot shaped pieces; PVC flexible vinyl, and Tyvek FC a Dupont product. The PVC vinyl is seal bonded in the seam, the Tyvek FC is seal stitched closed. Both materials are environmentally accepted as non-hazardous for waste disposal. The PVC material is 0.007 mm in thickness which is very light weight. The Tyvek FC is paper thin thus very light weight. Two release coated tape closures 20 are indicated at the measured intervals along the open back seam 14. These tapes are 3-M manufactured and cut specifically for this invention. The cover of the adhesive surface of the release coated tape is removed to stick the tape to the other side of the cover as the two sides overlap. The top tape closure is placed 2" below the top of the cover along the side of the open seam. The bottom tape closure is placed 2" above the double seal stopping point of 18 on the same side of the open seam as top closure.

The tape closures to not seal the seam, giving a ventilation space to relieve heat discomfort of the fluid resistant, fluid proof, impermeable material.

Figure 2:
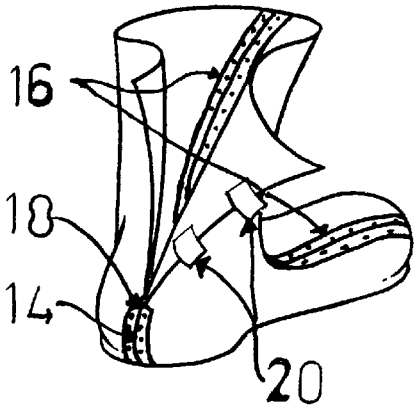

FIG. 2 denotes the disposable one time use, protective cover in a boot shape, in the open position for the back seam 14. The foot is inserted in this opening. The double sealed stopping point 18, of seam 14 prevents ripping or tearing while putting on the cover. One side of the open portion of seam 14 with the tapes, 20, wraps over the opposite side. The tapes seal onto the cover to close. The seal stitched seam 16 indicates the sealed stitched seam as solid lines on the inside of the cover; as dotted lines denote seal stitched seam from the outer view on the toe.

Figure 3:
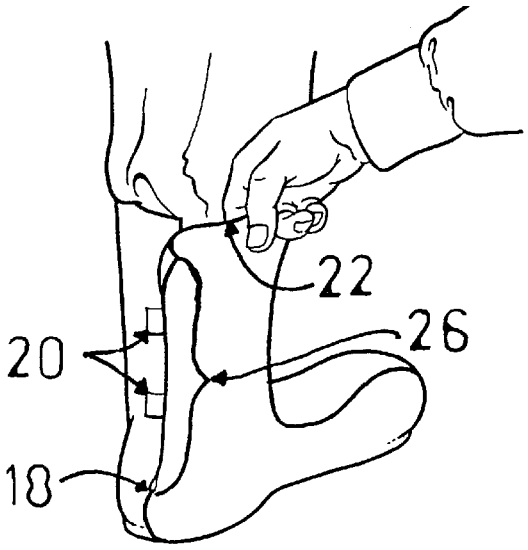
FIG. 3. The perspective of the disposable one time use, protective boot shaped cover shown with tapes closed, and hand positioned to rip open the closure tapes to remove cover FIG. 4 The disposable one time use, protective cover depicted with tapes torn apart, the clean inside is visible, unsoiled, available to touch as cover is pushed off foot.

FIG. 3 shows the method of removal of the cover from the foot and leg. Number 22, the top of the cover, a finger is inserted, and a quick snap breaks the tape closures, 20, open.

Figure 4:
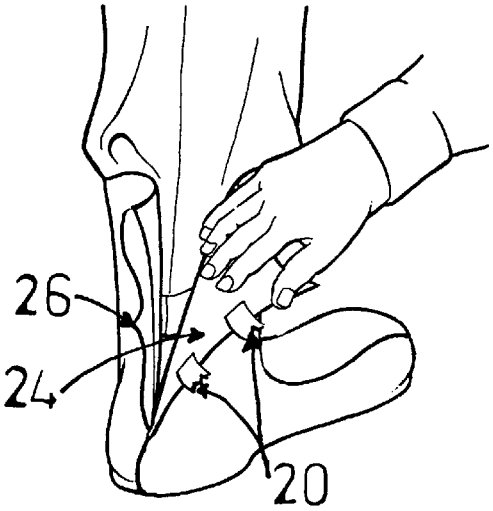

FIG. 4 denotes the disposable protective cover, 10, open for removal as closures, 20, are snapped apart. The clean inside of the cover, 24, is now available for use to push the cover off the foot. The contaminated outside now becomes the inside for easy disposal of the one time use cover in regular trash. Number 26 denotes the area of seam 14, which is not closed by the tapes, 20, which allows for ventilation.

The advantage to the user of this disposable one time use protective boot shaped cover, is three fold; compliance with federal regulations for healthcare worker skin protection; compliance with environmental regulations for disposal; compliance with infection control for reducing risk of transmission of infectious material. It is apparent from the descriptions of the drawings that many modifications may be made. These descriptions are examples only, and this invention is not limited to these. It is understood that it is intended in the attached claims for all such modifications to fall within the spirit and scope of the invention.

I claim:

1. A disposable protective shoecover for covering a wearer's shoe for use by health care workers, comprising:

two pieces of fluid resistant, fluid proof, impermeable material, said pieces being mirrored images of each other and shaped to cover the entire shoe of the wearer including the foot and extending to the lower leg of the wearer, the two pieces are joined together at outer edges by a continuous seam, the continuous seam extends from a top of a front of the shoecover to under a sole of the wearer's shoe to a lower back of the shoe cover, the seam is double sealed closed to prevent ripping and tearing, an upper and lower double coated adhesive closures are placed along the outer edges of one of the two pieces, said closures are along the back of the shoecover between the continuous seam at the lower back to an upper back of the shoecover, the closures are spaced at two intervals along the back, the upper closure is spaced two inches from the top of the shoecover, the closures may be resealed and released with the other of the said two pieces, wherein the closures are easily released by inserting a finger in a top of the upper back of the shoecover and then removing the shoecover, whereby the finger only touches an interior of the shoecover upon removal.

* * * * *